US009424975B2

(12) United States Patent
Cook et al.

(10) Patent No.: US 9,424,975 B2
(45) Date of Patent: Aug. 23, 2016

(54) SPLIT CORE TRANSFORMER WITH SELF-ALIGNING CORES

(71) Applicant: Veris Industries, LLC, Tualatin, OR (US)

(72) Inventors: Martin Cook, Tigard, OR (US); Mark D. Rowan, Wilsonville, OR (US); Marc Bowman, McMinnville, OR (US); Troy Earl Wecker, Portland, OR (US); Mark Taft, Tualatin, OR (US); Gary Richmond, Tualatin, OR (US); Cristin Rosenbaum, Tualatin, OR (US); Kenneth Courian, Tualatin, OR (US); Doug Porter, Tualatin, OR (US)

(73) Assignee: Veris Industries, LLC, Tualatin, OR (US)

( * ) Notice: Subject to any disclaimer, the term of this patent is extended or adjusted under 35 U.S.C. 154(b) by 41 days.

(21) Appl. No.: 14/466,681

(22) Filed: Aug. 22, 2014

(65) Prior Publication Data

US 2015/0054609 A1 Feb. 26, 2015

Related U.S. Application Data

(60) Provisional application No. 61/869,344, filed on Aug. 23, 2013.

(51) Int. Cl.

| | |
|---|---|
| ***H01F 27/04*** | (2006.01) |
| ***H01F 27/06*** | (2006.01) |
| ***H01F 38/30*** | (2006.01) |

(52) U.S. Cl.
CPC ..... *H01F 27/04* (2013.01); *H01F 27/06* (2013.01); *H01F 38/30* (2013.01)

(58) Field of Classification Search
CPC ..... H01F 27/00–27/30
USPC ..... 336/90, 92, 96, 210–215, 233–234
See application file for complete search history.

(56) References Cited

U.S. PATENT DOCUMENTS

| | | | | |
|---|---|---|---|---|
| 1,100,171 | A | 6/1914 | Brown | |
| 1,455,263 | A | 5/1923 | Oberfell | |
| 1,569,723 | A | 1/1926 | Dickinson | |
| 1,800,474 | A | 4/1931 | Scherer | |
| 1,830,541 | A | 11/1931 | Harris | |
| 1,871,710 | A | 8/1932 | Lenehan | |
| 2,059,594 | A | 11/1936 | Massa, Jr. | |
| 2,175,934 | A * | 10/1939 | Wentz | H01F 38/30 336/175 |
| 2,411,405 | A | 11/1946 | Yuhas | |
| 2,412,782 | A | 12/1946 | Palmer | |
| 2,428,613 | A | 10/1947 | Boyajian | |
| 2,428,784 | A | 10/1947 | Cole | |
| 2,512,070 | A | 6/1950 | Nelsen et al. | |
| 2,663,190 | A | 12/1953 | Ilgenfritz | |
| 2,746,295 | A | 5/1956 | Lubkin | |
| 2,802,182 | A | 8/1957 | Godshalk et al. | |
| 2,852,739 | A | 9/1958 | Hansen | |
| 2,943,488 | A | 7/1960 | Strobel et al. | |
| 3,190,122 | A | 6/1965 | Edwards | |
| 3,243,674 | A | 3/1966 | Ebert | |

(Continued)

*Primary Examiner* — Tuyen Nguyen
(74) *Attorney, Agent, or Firm* — Chernoff Vilhauer McClung & Stenzel, LLP

(57) ABSTRACT

A first housing portion of a split core sensing transformer includes a guide element arranged to engage a guide surface of a separable second housing portion and to control rotation and translation of the housing portions to align the housing portions during joining.

14 Claims, 6 Drawing Sheets

(56) References Cited

U.S. PATENT DOCUMENTS

| | | | |
|---|---|---|---|
| 3,287,974 | A | 11/1966 | Clemochowski |
| 3,374,434 | A | 3/1968 | Perry |
| 3,493,760 | A | 2/1970 | Hoadley |
| 3,512,045 | A | 5/1970 | Tipton et al. |
| 3,584,294 | A | 6/1971 | Siwko |
| 3,593,078 | A | 7/1971 | Domshy |
| 3,696,288 | A | 10/1972 | Carman |
| 3,728,705 | A | 4/1973 | Atkins |
| 3,769,548 | A | 10/1973 | Pardue |
| 3,772,625 | A | 11/1973 | Raupach |
| 3,861,411 | A | 1/1975 | Mitchell et al. |
| 3,955,701 | A | 5/1976 | Fisch |
| 3,976,924 | A | 8/1976 | Vanjani |
| 4,001,647 | A | 1/1977 | Klein et al. |
| 4,001,758 | A | 1/1977 | Esper et al. |
| 4,007,401 | A | 2/1977 | Kimmel et al. |
| 4,030,058 | A | 6/1977 | Riffe et al. |
| 4,048,605 | A | 9/1977 | McCollum |
| 4,058,768 | A | 11/1977 | Milkovic |
| 4,096,436 | A | 6/1978 | Cook et al. |
| 4,107,519 | A | 8/1978 | Bicek |
| D249,883 | S | 10/1978 | Collins |
| 4,124,030 | A | 11/1978 | Roberts |
| 4,151,578 | A | 4/1979 | Bell |
| 4,158,217 | A | 6/1979 | Bell |
| 4,158,810 | A | 6/1979 | Leskovar |
| 4,177,496 | A | 12/1979 | Bell et al. |
| 4,198,595 | A | 4/1980 | Milkovic |
| 4,207,604 | A | 6/1980 | Bell |
| 4,215,278 | A | 7/1980 | Barbier et al. |
| 4,227,419 | A | 10/1980 | Park |
| 4,241,237 | A | 12/1980 | Paraskevakos et al. |
| 4,249,264 | A | 2/1981 | Crochet et al. |
| 4,250,449 | A | 2/1981 | Shum |
| 4,253,336 | A | 3/1981 | Pietzuch |
| 4,258,348 | A | 3/1981 | Belfer et al. |
| 4,297,741 | A | 10/1981 | Howell |
| 4,328,903 | A | 5/1982 | Baars |
| 4,354,155 | A | 10/1982 | Speidel et al. |
| 4,359,672 | A | 11/1982 | Hart |
| 4,362,580 | A | 12/1982 | Kane et al. |
| 4,363,061 | A | 12/1982 | Vaerewyck et al. |
| 4,371,814 | A | 2/1983 | Hannas |
| 4,373,392 | A | 2/1983 | Nagamoto |
| 4,384,289 | A | 5/1983 | Stillwell et al. |
| 4,386,280 | A | 5/1983 | Ricaud et al. |
| 4,388,668 | A | 6/1983 | Bell et al. |
| 4,393,714 | A | 7/1983 | Schmidt |
| 4,398,426 | A | 8/1983 | Park et al. |
| 4,408,175 | A | 10/1983 | Nelson et al. |
| 4,413,193 | A | 11/1983 | Crockett |
| 4,413,230 | A | 11/1983 | Miller |
| 4,426,673 | A | 1/1984 | Bell et al. |
| 4,432,238 | A | 2/1984 | Tward |
| 4,475,081 | A | 10/1984 | Kobayashi |
| 4,491,790 | A | 1/1985 | Miller |
| 4,495,463 | A | 1/1985 | Milkovic |
| 4,506,199 | A | 3/1985 | Asche |
| 4,558,310 | A | 12/1985 | Mcallise |
| 4,558,595 | A | 12/1985 | Kompelien |
| 4,574,266 | A | 3/1986 | Valentine |
| 4,605,883 | A | 8/1986 | Cockroft |
| 4,621,532 | A | 11/1986 | Takagi et al. |
| 4,660,407 | A | 4/1987 | Takami et al. |
| 4,709,339 | A | 11/1987 | Fernandes |
| 4,739,229 | A | 4/1988 | Heiler, Jr. |
| 4,746,809 | A | 5/1988 | Coleman et al. |
| 4,754,365 | A | 6/1988 | Kazahaya |
| 4,757,416 | A | 7/1988 | Wilkerson |
| 4,758,962 | A | 7/1988 | Fernandes |
| 4,783,748 | A | 11/1988 | Swarztrauber et al. |
| 4,794,327 | A | 12/1988 | Fernandes |
| 4,808,910 | A | 2/1989 | Kessi |
| D301,331 | S | 5/1989 | Rhodin |
| 4,851,803 | A | 7/1989 | Hahn |
| 4,855,671 | A | 8/1989 | Fernandes |
| 4,874,904 | A | 10/1989 | DeSanti |
| 4,885,655 | A | 12/1989 | Springer et al. |
| 4,887,018 | A | 12/1989 | Libert |
| 4,890,318 | A | 12/1989 | Crane et al. |
| 4,926,105 | A | 5/1990 | Mischenko et al. |
| 4,939,451 | A | 7/1990 | Baran et al. |
| 4,944,187 | A | 7/1990 | Frick et al. |
| 4,956,588 | A | 9/1990 | Ming |
| 5,449,991 | A | 9/1995 | Owen |
| 6,018,239 | A | 1/2000 | Berkcan et al. |
| 6,064,192 | A | 5/2000 | Redmyer |
| 6,118,077 | A | 9/2000 | Takeuchi |
| 6,507,261 | B1 | 1/2003 | Haga et al. |
| 6,794,769 | B2 | 9/2004 | Black |
| 6,950,292 | B2 | 9/2005 | Holce et al. |
| 7,359,809 | B2 | 4/2008 | Bruno |
| 7,447,603 | B2 | 11/2008 | Bruno |
| 7,969,271 | B2 | 6/2011 | Lai et al. |
| 8,421,443 | B2 | 4/2013 | Bitsch |
| 8,587,399 | B2 * | 11/2013 | Crutcher ..... H01F 27/24 336/173 |
| 9,177,718 | B2 * | 11/2015 | Cook ..... H01F 27/06 |
| 2005/0127895 | A1 | 6/2005 | Rittmann |
| 2006/0129339 | A1 | 6/2006 | Bruno |
| 2007/0205750 | A1 | 9/2007 | Yakymyshyn et al. |
| 2009/0115403 | A1 | 5/2009 | Bernklau |
| 2010/0207604 | A1 | 8/2010 | Bitsch |
| 2013/0200971 | A1 | 8/2013 | Crutcher et al. |
| 2013/0271895 | A1 | 10/2013 | Kuhns |

* cited by examiner

SPLIT CORE TRANSFORMER WITH SELF-ALIGNING CORES

CROSS-REFERENCE TO RELATED APPLICATIONS

This application claims the benefit of U.S. Provisional App. No. 61/869,344, filed Aug. 23, 2013.

BACKGROUND OF THE INVENTION

The present invention relates to devices for sensing current in a conductor and, more particularly, to a split core current sensing transformer having core portions which self-align during assembly.

Allocation of power cost among members of a group of users, protection of circuits from overload and/or monitoring continued operation and/or malfunctioning of a remote circuit or device are just a few exemplary reasons for monitoring the flow of electric current in a conductor. Current monitoring is frequently performed with a sensing or current transformer (CT), typically comprising a coil of wire wrapped around the cross-section of a magnetically permeable core which, in turn, encircles a conductor in which the current is to be measured. An alternating current flowing in the conductor, the primary winding of the transformer, magnetizes the core inducing a current in the coil of wire, the secondary winding, which is substantially proportional to the current in the conductor and the ratio of the number of coils in the transformer's primary winding to the number of coils in the secondary winding.

Sensing transformers may have either a solid core or a split core. A solid core is typically a toroid of magnetically permeable material which encircles the conductor in which the current will be sensed. A disadvantage of a solid core sensing transformer is the requirement that the conductor be disconnected when installing the encircling toroidal core on the conductor. Where the conductor to be monitored has already been connected, a sensing transformer with a split core is often used to facilitate installation. Cota, U.S. Pat. No. 5,502,374, discloses a split core transformer comprising a pair of hinged housing halves each enclosing half of a toroidal transformer core. The transformer can be installed on a conductor by pivoting the free ends of the housing/core portions away from each other; positioning the conductor to be monitored in the center of one of the portions; and closing and latching the core halves around the conductor. Bernklau, U.S. Patent Publication No. 2009/0115403, discloses another split core transformer comprising hinged C-shaped or U-shaped transformer core portions. While a hinged split core transformer can be installed without disconnecting the conductor in which the current is to be monitored, sensing transformers are commonly installed in enclosures, such as, a motor starter enclosure, where there is insufficient room to open the hinged portions and maneuver the conductor into position. Bruno, U.S. Pat. No. 7,312,686, discloses a split core current transformer comprising separable core portions. While the disassembled transformer requires no more space than the assembled transformer, it can be difficult to align the core portions when reassembling the core, particularly, in the crowded confines of an enclosure for electrical equipment.

What is desired, therefore, is a split core sensing transformer including core portions which can be conveniently assembled in a limited or crowded space.

DETAILED DESCRIPTION OF PREFERRED EMBODIMENTS

Figure 1:
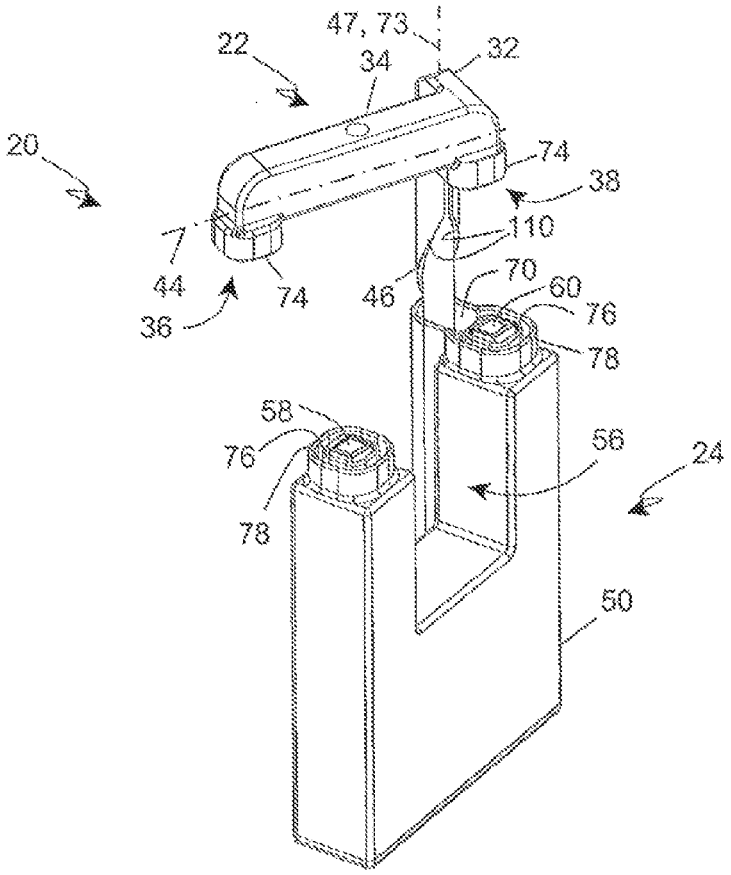
FIG. 1 is an isometric view of a split core sensing transformer with separated and rotated transformer portions.

Referring in detail to the drawings where similar parts are identified by like reference numerals, and, more particularly to FIGS. 1-6, a split core sensing transformer 20 comprises, generally, a first transformer portion 22 and a second transformer portion 24 which are separable and joinable by relative translation and rotation.

The first transformer portion 22 includes a first magnetically permeable core portion 30 which is contained in a first core housing 32. The first core housing 32 includes an elongate first portion 34 which encloses a substantial portion of the beam shaped first core portion 30. The first core housing includes portions defining apertures 36, 38 through which end portions 40, 42 of the first core portion 30 are exposed. The centers of the apertures 36, 38 define a longitudinal axis 44 of the first core portion 30 and the elongate portion 34 of the first core housing 32 which encloses the first core portion. Although it might comprise other materials, preferably, the first core housing comprises a resilient, insulating plastic.

Figure 2:
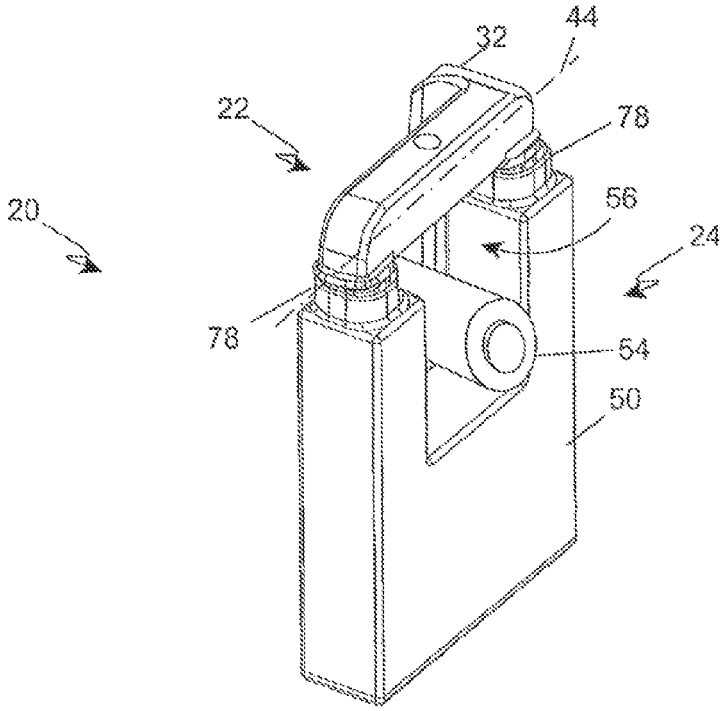
FIG. 2 is an isometric view of the split core sensing transformer of FIG. 1 with joined transformer portions.
Figure 3:
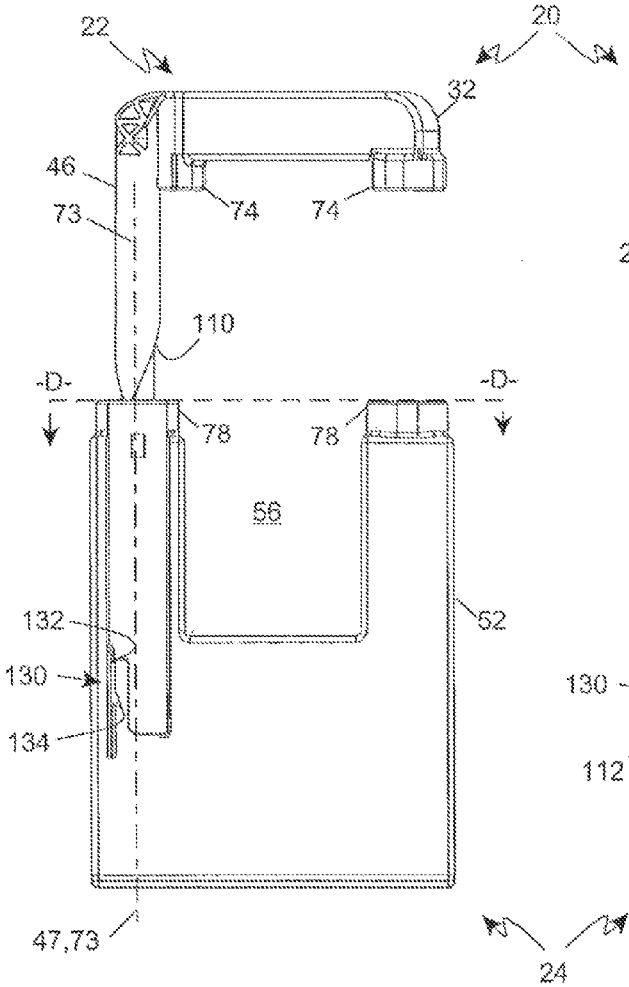
FIG. 3 is an elevation view of the split core sensing transformer of FIG. 1 with separated and rotated transformer portions.
Figure 4:
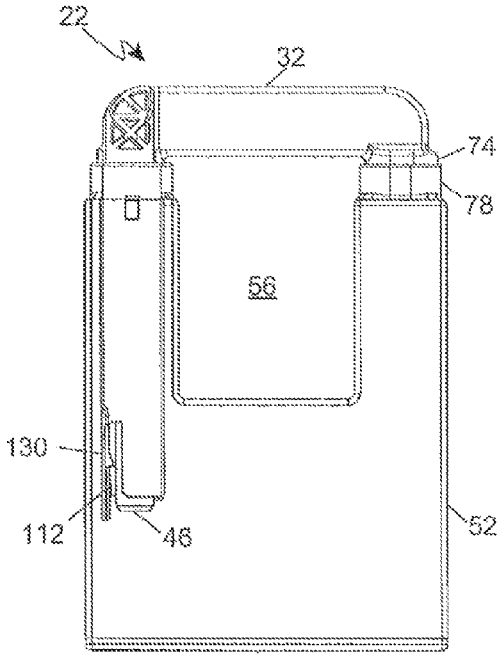
FIG. 4 is an elevation view of the split core sensing transformer of FIG. 1 with joined transformer portions.
Figure 5:
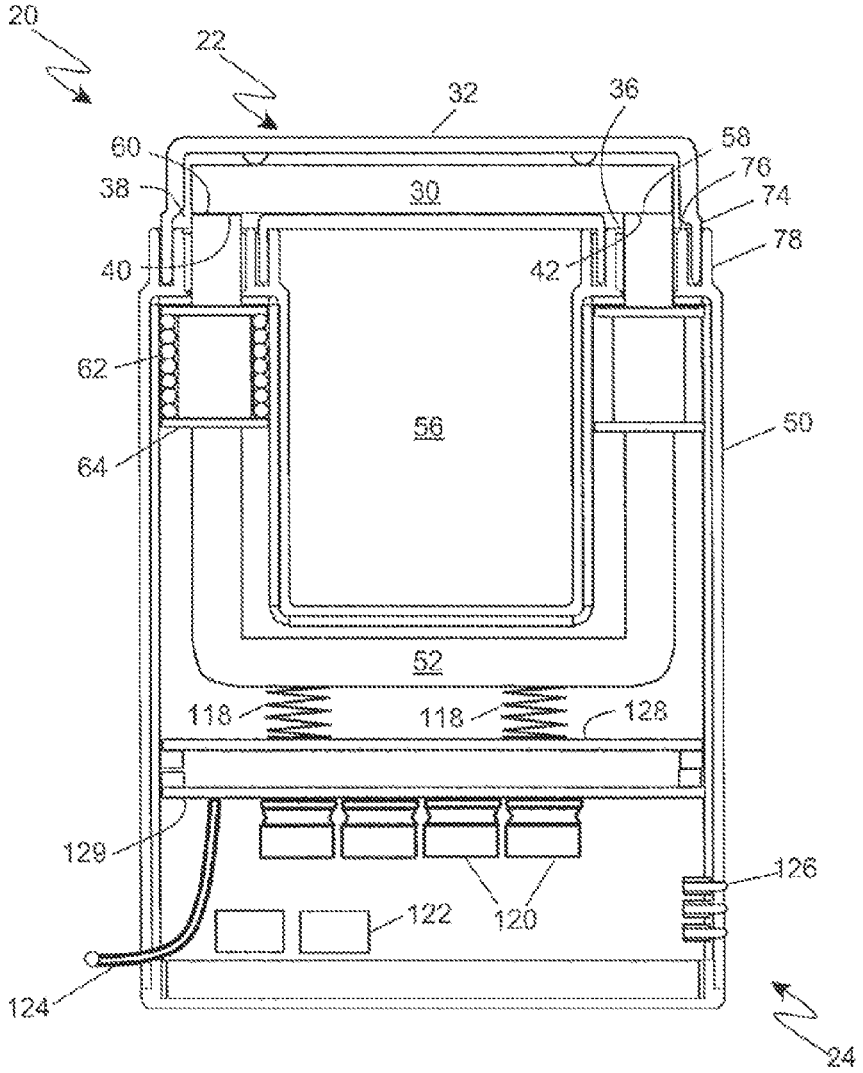
FIG. 5 is a cutaway view of the split core transformer of FIG. 4.

The second transformer portion 24 comprises, generally, a U-shaped, second magnetically permeable core portion 52 which is contained in a second U-shaped core housing 50 which also comprises, preferably, a resilient, insulating plastic material. Referring to FIG. 2, to sense current in a conductor 54, the conductor is passed through a central opening 56 in the transformer which is formed when the end portions 40, 42 of the first core portion 30 are joined with the end portions 58, 60 of the U-shaped, second core portion 52. An alternating current in the conductor will induce an expanding and collapsing magnetic field in the encircling core portions 30 and 52 which will, in turn, induce an electric current and voltage in the wire of a secondary winding 62 which is wound on a bobbin 64 and which encircles the cross-section of one of the core portions. The ratio of the current induced in the secondary winding of the sensing transformer to the current flowing in the conductor 54 is substantially proportional to the ratio of the number of turns in the primary winding to the number of turns in the secondary winding. The number of turns in the primary winding is commonly one as the conductor is commonly passed through central opening of sensing transformer only once. To provide access to the portion of the central opening 56 defined by the U-shaped second transformer portion 24, the joined transformer portions 22, 24 may be separated by relative translation and/or rotation as illustrated in FIG. 1 even to the point of detachment from each other as illustrated by transformer portions 152, 154 in FIG. 6.

While the exemplary sensing transformer 20 comprises a beam shaped first core portion and a U-shaped second core portion, split core sensing transformers commonly include two U-shaped core portions or a C-shaped core portion in combination with a second C-shaped core portion or a U-shaped core portion and can comprise plural core portions of one or more other shapes which when brought into contact with each other can be arranged to encircle a conductor. For example, referring to FIG. 6, the split core transformer housing 150 includes a first housing portion 152 arranged to enclose a C-shaped core portion and a second housing portion 154 arranged to enclose a U-shaped core portion.

While disconnecting the conductor to be monitored is unnecessary when installing it in the central opening of a split core sensing transformer, sensing transformers are often installed in small and/or crowded enclosures where there may be insufficient room to open the sections of a hinged split core or where the open hinged core portion may block access to the conductor, a portion of the sensing transformer or other equipment in the enclosure. The portions of some split core transformers are separable facilitating installation of the transformer in spaces which are only a little larger than the space occupied by the assembled transformer but aligning the portions during reassembly may be difficult, particularly, in a confined or crowded space. The inventor concluded that if the portions of a sensing transformer could be rotated relative to each other about an axis offset from the axis defined by the end portions of one of the transformer core portions, the available space around the transformer could be utilized more effectively and obstacles could be avoided and if the core portions of a sensing transformer self-aligned as the transformer cores were joined, following installation of the conductor, installation of the sensing transformer, including reassembly of separated core portions, would be facilitated, particularly, in crowded or close environments.

Figure 10:
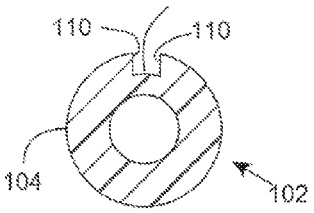
FIG. 10 is a section view of a first section of the guide pin of the first transformer portion of FIGS. 7-9 taken along line A-A.
Figure 11:
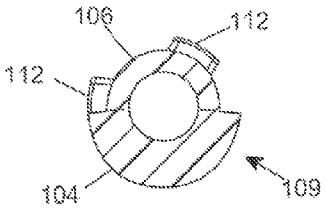
FIG. 11 is a section view of a second section of the guide pin of the first transformer portion of FIGS. 7-9 taken along line B-B.
Figure 12:
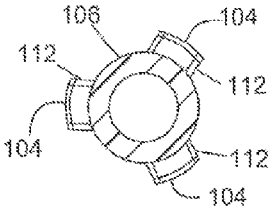
FIG. 12 is a section view of a third section of the guide pin of the first transformer portion of FIGS. 7-9 taken along line C-C.

The first core housing 32 includes a portion defining an elongate guide pin 46 that projects substantially normal to the longitudinal axis 44 of the elongate portion 34 of first core housing 32 which houses the first core portion 30. Referring also to FIGS. 7-12, the guide pin 46 has a surface defined by the respective surfaces of plural cylindric sections taken normal to and spaced along the pin's longitudinal axis 47. The surfaces of the cylindric sections preferably comprise arcuate surfaces of varying lengths of one or more sectors of varying radius and, where appropriate, surfaces that connect the arcuate surface portions of sectors of differing radii. Referring to FIG. 10, cylindric sections, exemplified by section 102, spaced along a first length 82 of the guide pin 46, proximate the connection of the guide pin to the portion 34 of the first transformer housing enclosing the first transformer core portion 30 have a surface defined by the arcuate surface 104 of a first sector having a larger radius and the arcuate surface 106 of a second sector of smaller radius. The transition between the surface 104 of first sector and the surface 106 of the second sector defines a portion of a directing element 108, an enlarged portion of the guide pin 46, bounded by closely spaced, parallel portions of a directing surface 110 which project approximately normal to the surface of the guide pin and extend longitudinally for the first length 82 of the guide pin. Referring to FIG. 11, as exemplified by the cylindric section 109, the surface of cylindric segments taken along a second length 84 of the guide pin comprise a surface portion 104 of the larger radius sector radius and a surface portion 106 of the smaller radius sector but the relative lengths of the respective sector surfaces vary defining portions of the directing surface 110 extending from the ends of the respective first lengths of the directing surfaces and spirally diverging around the pin 46 to an intersection 86 on the side of the pin opposite the parallel first lengths of the directing surface 110. The guide pin 46 includes a third length 88, distal of the second length 84, where the surfaces of plural cylindric segments comprise the arcuate surfaces 106 of circles of the smaller radius. Over a fourth length 90 of the guide pin 46, cylindric sections comprising alternating sectors of the larger radius and the smaller radius form the surfaces 104 of plural triangular projecting surface portions 112 which are spaced around the circumference of the guide pin.

Figure 13:
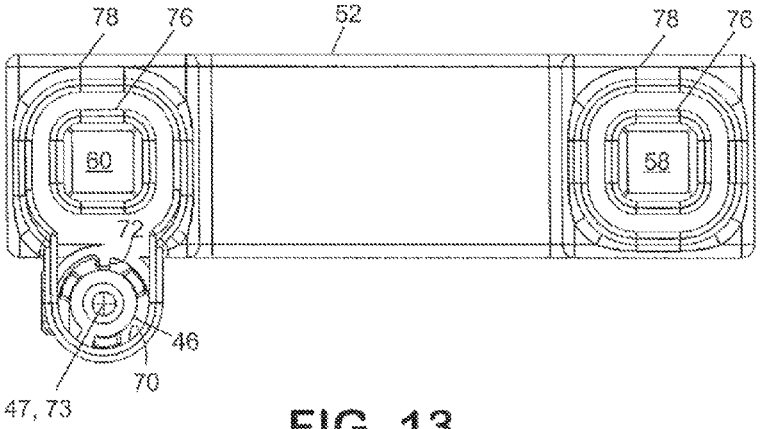
FIG. 13 is a section view of the split core transformer of FIG. 3 taken along line D-D.

The second core housing 50 includes a portion defining an elongate guide pin socket 70 to slidingly receive the guide pin 46 of the first core housing 32. When the guide pin 46 is inserted into the guide pin socket 70, the projecting triangular raised surface portions 112 slidingly contact the inner surface of the socket providing initial guidance to the translation of the guide pin and second transformer portion 22. Referring also to FIG. 13, the portion of the second core housing defining the guide pin socket 70 also defines a second directing element 72, a tab or block, projecting from the inner surface of the socket toward the center of the socket. As the guide pin 46 translates into the guide pin socket 70, the second directing element 72 slidingly engages the directing surface 110 of the first directing element 108, the larger portion of the guide pin, and urges the first transformer portion 22 to rotate relative to the second transformer portion, if necessary, to align the exposed end portions 40 and 42 of the first core portion 30 with the respective end portions 60 and 58 of the second core portion 52 and to maintain alignment of the end portions of the first and second core portions as the second directing element enters the narrowly spaced, parallel portions of the directing surface proximate the housing portion 34. The larger cross-section of the pin 46 proximate the housing portion 34 also controls the direction of translation of the first transformer portion 22 as the transformer portions approach contact.

The first core housing 32 includes projecting lips 74 which at least partially surround the apertures 36, 38 through which end portions 40, 42 of the first core portion 30 are exposed. Similarly, projecting lips 76, 78 of the second core housing 50 at least partially surround each of the exposed ends 58, 60 of the second core portion 52. The lips 74 are arranged to intermesh with the lips 76, 78 as the first core portion 30 engages the second core portion 52 to secure the joined transformer portions against separation by rotation and to extend a surface path length to satisfy creepage and clearance requirements.

To assure contact between the end portions 40, 42 of the first core portion 30 and the end portions 58, 60 of the second core portion 52 when the transformer portions are joined, one or more resilient members 118 bearing on the second core portion and a partition 128 secured within the second core housing 50 urge the end portions 58 and 60 of the second core portion 52 toward the first core portion 30. Alternatively or additionally, the first portion 30 could be urged toward the second core portion by a resilient member acting between the top the first core portion and an inner surface of the first core housing 32. Preferably, the first core portion 30 is spaced from the inner wall of the first core housing 32 by a centrally located fulcrum 33 which equalizes the forces of contact with the second core portion and permits movement of the end portions of the first core portion to achieve the best contact with ends of the second core portion.

When the first and second core portions are brought into contact, a surface 136 of a triangular raised surface portion 112 moves past a surface 134 of a locking element 130 projecting toward the center 73 the guide pin socket 70. The resilient material of the second housing portion 50 defines a spring portion 132 which urges the locking element 130 toward the center of the guide pin interlocking respective surfaces 134 of the locking element and surface 136 of one of the triangular raised surface portions 112 to automatically lock the transformer core portions in the joined position.

Figure 6:
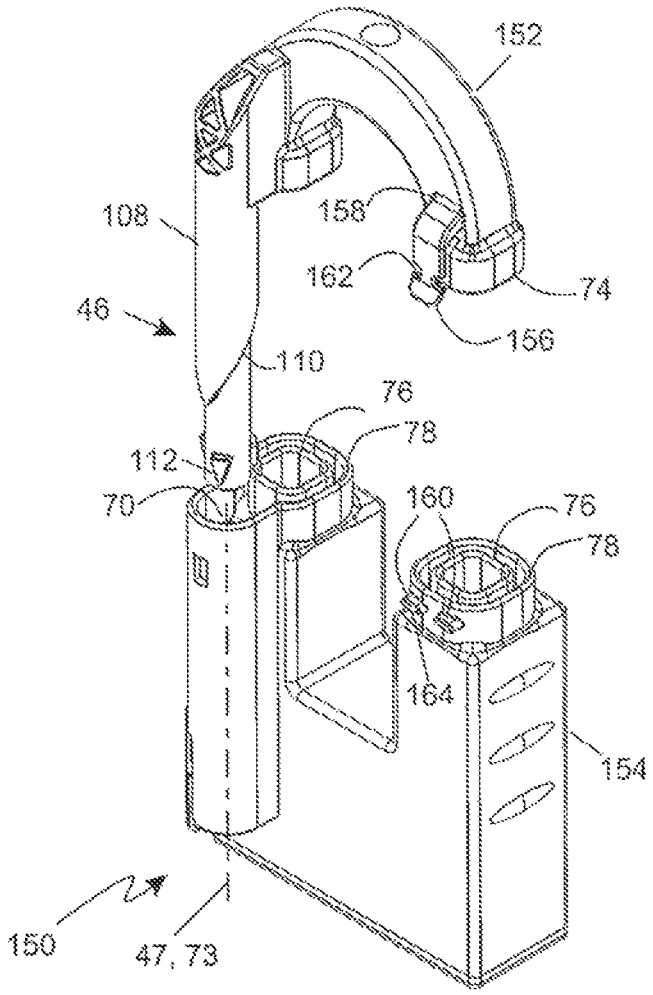
FIG. 6 is an isometric view of a housing for a sensing transformer which comprises a C-shaped core portion.
Figure 9:
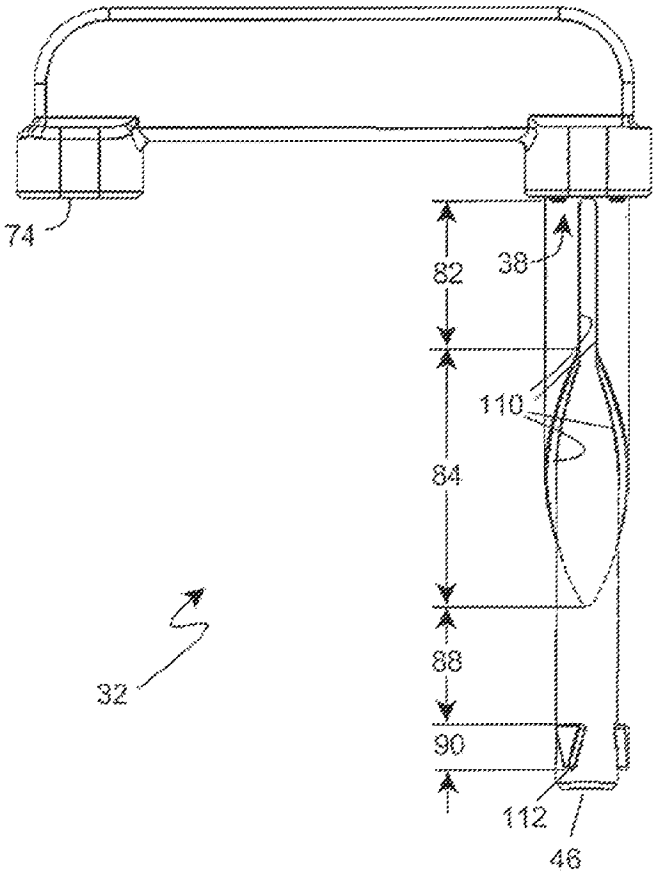
FIG. 9 is an opposite side elevation view of the first transformer portion of FIG. 7.
Figure 8:
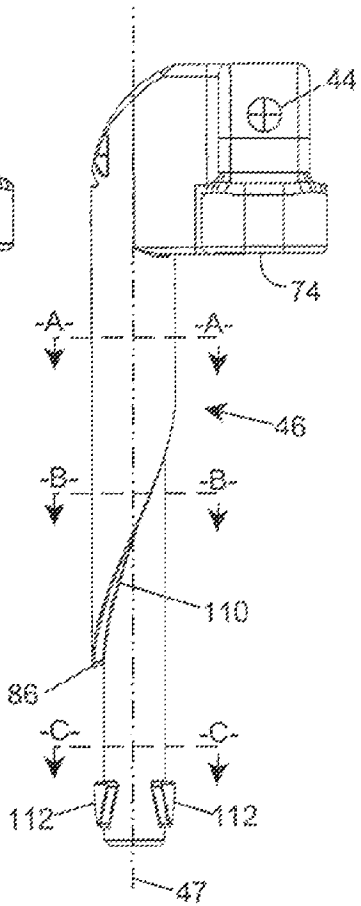
FIG. 8 is an end view of the first transformer portion of FIG. 7.
Figure 7:
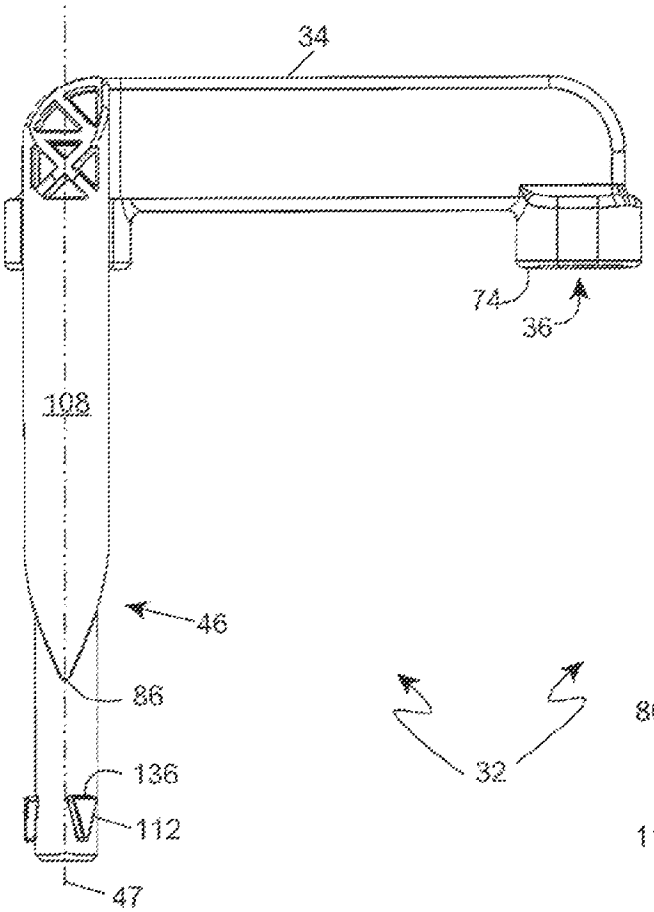
FIG. 7 is an elevation view of a first portion of the transformer of FIG. 1.

Alternatively or additionally, as illustrated in FIG. 6, the first 152 and second 154 core housings could define a latch assembly comprising a first engaging element 158 cantilevered from one of the core housings and a fixed second engaging element 160, for example, spaced blocks, projecting from the other core housing. As the core portions are brought into contact, a sloping portion 156 of the first engaging element contacts the second engaging element elastically deforming the first engaging element. As the core portions contact, interlocking surfaces 162 of the first engaging element 156 are resiliently urged into engagement with surfaces 164 of the fixed engaging element(s) 160 to lock the housing portions against separation.

A circuit board 129 is suspended in the second core housing 50 or in a configurable detachable end cap 51. The circuit board 129 supports elements of an electronic circuit which typically conditions the output of the secondary winding 62 and commonly responds in some way to the electric current induced in the winding. For example, the exemplary sensing transformer 20 includes one or more capacitors 120 attached to the circuit board for filtering the signal induced in the secondary winding 62, one or more trimpots 122 for adjusting the sensing circuit for the effect of variations in the characteristics of the detector circuit's components and plural light emitting diodes (LEDs) 126 to indicate the functioning and/or malfunctioning of the sensing transformer and/or a detector circuit. A lead 124 conducts the output of the sensing transformer and/or detector circuit to remote equipment. By way of examples only, Cota, U.S. Pat. No. 5,502,374, and Bernklau, U.S. Patent Publication No. 2009/0115403, incorporated herein by this reference, disclose exemplary circuit schematics comprising sensing transformers, for, respectively, a current sensor and a low threshold current switch which are exemplary of circuits which might be incorporated on the circuit board.

To gain access to the central aperture of the split core sensing transformer 20 to install a conductor 54 for monitoring, the first transformer portion 22 can be moved in translation relative to the second transformer portion 24 by releasing the interlocking surfaces 136, 134 of the latch assembly and sliding the guide pin 46 longitudinally in the guide pin socket 70 to disengage the lips 74 of the first transformer portion 22 from the intermeshing lips 76, 78 of the second transformer portion 24. Continued translation for a distance equal to the first length 82 of the guide pin, releases the second directing element 72 from the narrowly spaced, parallel portions of the directing surface 110 releasing the transformer portions for relative rotation. Continued separation of the transformer portions 22, 24 allows increasing amounts of rotation about the longitudinal axis 73 of the guide pin socket 70 which is offset from the side of the second transformer core portion 52 facilitating access to the central part of the second core housing 50. When the second transformer portion 22 is separated from the first transformer portion 24 by a distance equal to the sum of the first length 82 and the second length 84, the transformer portions are free to rotate fully relative to each other. Further translation will withdraw the guide pin 46 from the guide pin socket 70. Space around the sensing transformer can be utilized more effectively because the transformer portions can be rotated relative to each other to avoid obstacles on either side of the transformer and can be separated, if necessary, to minimize the area occupied by the transformer during installation of the conductor that is to be monitored.

When the conductor which is to be monitored 54 has been placed in the center portion of the U-shaped second transformer portion 24, the guide pin 46 is inserted in the socket 70 if the transformer portions have been separated. Slidingly engaging the surfaces 104 of the triangular elements 112 of the guide pin with the wall of the guide pin socket 70 controls the direction in which the first transformer portion 22 translates relative to the second transformer portion. As the transformers portion are urged toward the joined position, the surface 110 of the first directing element 108 engages the second directing element 72 and relative rotation of the transformer portions 22, 24 to align the end portions 40, 42, of the first core portion 30 with the end portions 58, 60 of the second core portion 52 will be urged, if necessary, as the guide pin continues to translate in the socket. The sliding engagement of the surface of the first directing element 108 with the wall of the guide pin socket further directs the relative translation of the transformer portions. Further, translation of the transformer portions 22, 24 toward the closed position, engages the intermeshing lip portions 74, 76, 78 further restricting relative movement of the transformer portions. As the end portions of the first 30 and second 52 core portions contact the resilient elements 118 are compressed and surfaces 134, 136 of the latch elements 112 and 130 engage and interlock as a result of the urging of the spring portion 132 securing the transformer portions 22, 24 and the transformer core portions 30, 52 against separation.

Relative translation and rotation of portions of a split core sensing transformer about an axis offset from the core portions makes utilization of the space around the transformer more effective and self alignment the transformer core portions during joining facilitates use of the transformer in crowded or close environments.

The detailed description, above, sets forth numerous specific details to provide a thorough understanding of the present invention. However, those skilled in the art will appreciate that the present invention may be practiced without these specific details. In other instances, well known methods, procedures, components, and circuitry have not been described in detail to avoid obscuring the present invention.

All the references cited herein are incorporated by reference.

The terms and expressions that have been employed in the foregoing specification are used as terms of description and not of limitation, and there is no intention, in the use of such terms and expressions, of excluding equivalents of the features shown and described or portions thereof, it being recognized that the scope of the invention is defined and limited only by the claims that follow.

We claim:

1. A sensing transformer comprising:

(a) a first transformer portion defining a first guide element and a first directing element;

(b) a second transformer portion defining a second guide element and a second directing element, said second guide element slidingly engageable with said first guide element, said second directing element slidingly engageable with said first directing element, the combination of said second guide element being said slidingly engageable with said first guide element and said second directing element slidingly engageable with said first directing element to contemporaneously direct translation and rotation of said second transformer portion relative to said first transformer portion;

(c) a first latch element including a first latch surface projecting from said first guide element; and (d) a second latch element resiliently attached to said second transformer portion and including a second latch surface arranged to resiliently engage said first latch surface when a first core portion of said first transformer portion is urged into contact with a second core portion of said second transformer portion and to resist separation of said first core portion and said second core portion.

2. The sensing transformer of claim 1 further comprising:

(a) a first lip portion of said first transformer portion; and (b) a second lip portion of said second transformer portion, said first lip portion intermeshing with said second lip portion to restrain movement of said first transformer portion relative to said second transformer portion when said first core portion is in contact with said second core portion.

3. A sensing transformer comprising:

(a) a first transformer portion defining a first guide element and a first directing element;

(b) a second transformer portion defining a second guide element and a second directing element, said second guide element slidingly engageable with said first guide element, said second directing element slidingly engageable with said first directing element, the combination of said second guide element being said slidingly engageable with said first guide element and said second directing element slidingly engageable with said first directing element to contemporaneously direct translation and rotation of said second transformer portion relative to said first transformer portion;

(c) a first latch element affixed to one or said first transformer portion and said second transformer portion; and (d) a second latch element hingedly attached to the other of said first transformer portion and said second transformer portion and hingedly engageable with said first latch element to resist separation of a first transformer portion and said second transformer portion when a first core portion of said first transformer portion is in contact with second core portion of said second transformer portion.

4. The sensing transformer of claim 3 further comprising:

(a) a first lip portion of said first transformer portion; and (b) a second lip portion of said second transformer portion, said first lip portion intermeshing with said second lip portion to restrain movement of said first transformer portion relative to said second transformer portion when said first core portion is in contact with said second core portion.

5. A sensing transformer comprising:

(a) an elongate first core portion;

(b) a first core housing enclosing a portion of said first core portion and defining an elongate guide pin having a guide pin axis extending normal to a longitudinal axis of said first core portion and spaced from a side of said first core portion, said guide pin defining a first directing surface;

(c) a second core portion having plural end portions arranged for engagement with said first core portion; and (d) a second core housing enclosing a portion of said second core portion and defining a guide pin receiving socket spaced from a side of said second core portion, and a second directing element slidingly engageable with said first directing surface, the combination of (1) said guide pin and said guide pin receiving socket and (2) said second directing element slidingly engageable with said first directing surface to control translation and rotation of said first core housing relative to said second core housing as said first core portion is urged toward contact with said second core portion.

6. The sensing transformer of claim 5 further comprising:

(a) a projecting first lip portion of said first core housing at least partially encircling an exposed portion of said first core portion; and (b) a second lip portion of said second core housing at least partially encircling an end portion of said second core portion, said first lip portion and said second lip portion intermeshing to prevent separation of said first core housing and said second core housing when said first core portion is in contact with said second core portion.

7. The sensing transformer of claim 5 wherein said first directing surface comprises a surface connecting an arc of a first sector of a cylindric segment of said guide pin with an arc of a second sector of said cylindric segment, said first sector having a radius greater than a radius of said second sector.

8. The sensing transformer of claim 7 wherein a first portion of said directing surface proximate said first core portion comprises a first surface extending substantially parallel to a central axis of said guide pin and second surface extending substantially parallel to said first surface.

9. The sensing transformer of claim 8 wherein a second portion of said directing surface comprises spiral third surface portion extending from a distal end of said first surface and a spiral fourth surface portion extending from a distal end of said second surface and intersecting said third surface on a side of said guide pin substantially opposite said first surface.

10. The sensing transformer of claim 9 further comprising:

(a) a projecting first lip portion of said first core housing at least partially encircling an exposed portion of said first core portion; and (b) a second lip portion of said second core housing at least partially encircling an end portion of said second core portion, said first lip portion and said second lip portion intermeshing to prevent separation of said first core housing and said second core housing when said first core portion is in contact with said second core portion.

11. The sensing transformer of claim 5 further comprising:

(a) a first latch surface defined by said guide pin; and (b) a second latch surface defined by said second core housing and arranged to resiliently engage said first latch surface and to resist separation of said first core housing and said second core housing when said first core portion is urged into contact with said second core portion.

12. The sensing transformer of claim 11 further comprising:

(a) a projecting first lip portion of said first core housing at least partially encircling an exposed portion of said first core portion; and (b) a second lip portion of said second core housing at least partially encircling an end portion of said second core portion, said first lip portion and said second lip portion intermeshing to prevent separation of said first core housing and said second core housing when said first core portion is in contact with said second core portion.

13. The sensing transformer of claim 5 further comprising:

(a) a first latch element affixed to one of said first core housing and said second core housing; and (b) a second latch element hingedly attached to the other of said first core housing and said second core housing and including a surface engageable with a surface of said first latch element to resist separation of said first core housing and said second core housing when said first core portion is in contact with said second core portion.

14. The sensing transformer of claim 13 further comprising:

(a) a projecting first lip portion of said first core housing at least partially encircling an exposed portion of said first core portion; and (b) a second lip portion of said second core housing at least partially encircling an end portion of said second core portion, said first lip portion and said second lip portion intermeshing to prevent separation of said first core housing and said second core housing when said first core portion is in contact with said second core portion.

* * * * *